US005194900A

United States Patent [19]

Hagihara et al.

[11] Patent Number: 5,194,900

[45] Date of Patent: Mar. 16, 1993

[54] DEVELOPER CARTRIDGE HAVING EASILY REMOVABLE SEALING MATERIAL

[75] Inventors: Hideaki Hagihara, Nara; Hiroshi Kinashi, Tsuzuki, both of Japan

[73] Assignee: Sharp Kabushiki Kaisha, Osaka, Japan

[21] Appl. No.: 779,068

[22] Filed: Oct. 16, 1991

[30] Foreign Application Priority Data

Oct. 22, 1990 [JP] Japan ..... 2-285564

[51] Int. Cl.[5] ..... G03G 15/06

[52] U.S. Cl. ..... 355/260; 222/DIG. 1

[58] Field of Search ..... 355/215, 245, 260; 118/653; 222/DIG. 1; 229/123.1; 206/229, 222

[56] References Cited

U.S. PATENT DOCUMENTS

| | | | |
|---|---|---|---|
| 4,799,608 | 1/1989 | Oka | 222/DIG. 1 |
| 4,895,104 | 1/1990 | Yoshino et al. | 118/653 |
| 4,969,557 | 11/1990 | Oka | 222/DIG. 1 |
| 4,981,218 | 1/1991 | Ban et al. | 355/260 X |
| 5,027,156 | 6/1991 | Kobayashi | 355/245 |
| 5,030,998 | 7/1991 | Shibata et al. | 355/260 |
| 5,080,745 | 1/1992 | Paull | 355/260 X |

FOREIGN PATENT DOCUMENTS

| | | | |
|---|---|---|---|
| 0014864 | 1/1983 | Japan | 355/215 |
| 0117170 | 7/1986 | Japan . | |
| 0014264 | 1/1988 | Japan . | |
| 0094266 | 4/1988 | Japan | 355/245 |
| 0174360 | 11/1988 | Japan . | |
| 0281177 | 11/1988 | Japan | 355/260 |
| 0103072 | 4/1990 | Japan | 355/260 |
| 0198475 | 8/1990 | Japan | 355/260 |
| 0251981 | 10/1990 | Japan | 355/260 |

*Primary Examiner*—A. T. Grimley
*Assistant Examiner*—William J. Royer
*Attorney, Agent, or Firm*—David G. Conlin; Henry D. Pahl, Jr.

[57] ABSTRACT

A box-shaped container (10) has an opening (12) and the opening is sealed tightly and doubly by a sealing material (13). The sealing material is hot-glued to a peripheral portion of the opening of the cartridge body to such an extent that the sealing material can be peeled from the peripheral part. The end portion (13*a*) of the sealing material is bonded at an adequate length from the free end to the face 11*a* of a side of the peripheral portion, and the free end portion is turned down for 180 degree angle to the outer side of the opening. Furthermore, the sealing material is bonded to the face (11*b*) of a opposite side of the peripheral portion side at which the free end portion (13*a*) is adhered and turned down to cover the opening in double covering. The sealing material also covers the turned-down end portion. The other end portion (13*b*) of the sealing material is attached to a roller (16), and as the user turns a handle (18) of the roller, the sealing material can be peeled off easily.

5 Claims, 6 Drawing Sheets

DEVELOPER CARTRIDGE HAVING EASILY REMOVABLE SEALING MATERIAL

BACKGROUND OF THE INVENTION

1. Field of the Invention

This invention relates to a developer cartridge used for replenishing a developer to a developing device which develops a latent image formed on a photosensitive body or the like in an electrophotographic copier and so on.

2. Description of the Related Art

An electrophotographic copier, a laser printer or the like utilizing electrophotography is provided with a developing device for developing an electrostatic latent image on the photosensitive body by using powder toner. The toner is consumed each time an electrostatic latent image on the photosensitive body is developed. And, when the toner runs out, the toner tank of the developing device needs to be replenished with toner.

To simplify this replenishing operation, a detachable cartridge with the toner is mounted in the developing device, and when the developer runs out, the old cartridge is detached and replaced with a new cartridge filled with a developer. As disclosed in Japanese Utility Model Application Laying Open No. 63-14264 "Toner Cartridge for Copier", a box-shaped replenishing cartridge 1 is provide with an opening 2 for supplying the developer into a developer tank of a developing device and a flange portion 4 of the opening 2 is sealed tightly as shown in FIG. 1. The sealing material 3 has one end portion thereof 3*a* adhered to the face 4*a* of a side of the flange portion 4 of the container 1 of the developer cartridge. The sealing material 3 is at a middle portion thereof fixed to the face 4*b* of the opposite side of the flange portion 4 and turned down to cover the opening doubly and cover the end portion 3*a* of the sealing material fixed to the end face 4*a*, the other end 3*b* thereof being left as a free end. By pulling the free end 3*b* of the sealing material 3 in the arrow direction, the sealing material 3 is peeled from the face 4*b* of the flange portion 4. By pulling further, the sealing material is gradually separated from the flange portion 4 of the container 1. By this step, a developer filled in the container 1 is replenished to the developing device body through the opening 2 which is open.

The conventional developer replenishing cartridge shown in FIG. 1 requires a force for peeling the sealing material from the cartridge body 1 by pulling the sealing material. To be more specific, when the sealing material is pulled in the direction shown in FIG. 1 (the upward direction intersecting the peeling direction at right angles), the frictional force is large between the fixed end 3*a* of the sealing material and the overlapping portion 5 of the sealing material at a right-angle bent of the sealing material, and therefore, the force required for peeling off the sealing material 3 is very large. As a result, it is difficult to peel off the sealing material, which has been a problem.

SUMMARY OF THE INVENTION

It is therefore an object of the present invention to provide a developer cartridge capable of peeling off the sealing material easily, which is made possible by decreasing the frictional force of the sealing material.

A developer cartridge according to the present invention comprises a container containing the developer and having an opening for supplying the developer, and a sealing material adhered to a rectangular peripheral portion of the opening in such a manner that a free end portion of the sealing material is turned down for 180 degree angle at a certain length from a free end of the free end portion to a outer side of the opening and the sealing material following the free end portion is adhered at a side of the peripheral portion and covers the opening to seal the opening and is turned down at a opposite side to the side of the peripheral portion at which the free end portion is adhered and the sealing material covers the opening doubly and also covers the free end portion turned down.

In replenishing developer into a developing device, a new cartridge of the present invention is mounted in the developing device, and then the sealing material is peeled from the fixed part of the container by pulling the free end portion of the sealing material. In this case, the free end portion of the sealing member, which is turned down toward the outer side of the opening, is displaced in the direction in which the sealing material is pulled. Accordingly, the frictional force at the overlapping portion of the sealing material is reduced.

In a preferred embodiment the cartridge include a rotating member attached at a side surface of the container. The other end portion of the sealing material is fixed at the rotating member. The rotating member may have a handle for facilitating the rotation of the rotating member. Thereby the end portion of the sealing material can be peeled off easily by a rotational force. The sealing material peeled off is wound around the rotating member.

Further objects and advantages of the present invention will be apparent from the following description of the preferred embodiments of the invention as illustrated in the accompanying drawings.

DESCRIPTION OF THE PREFERRED EMBODIMENTS

Figure 3:
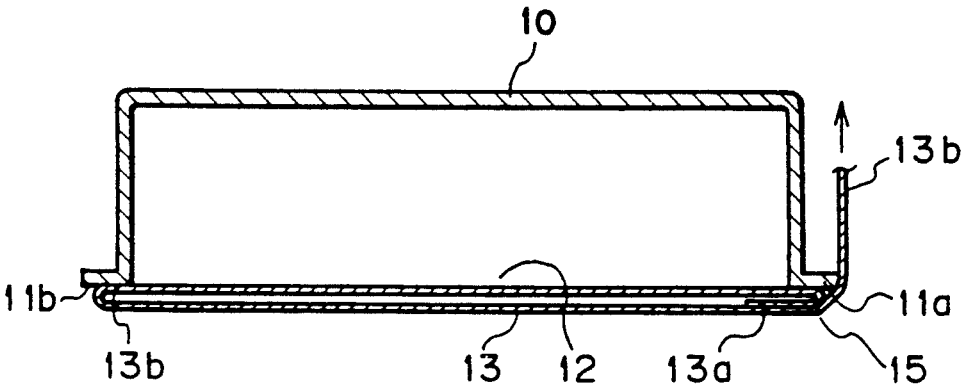
FIG. 3 is a cross sectional view of the developer cartridge shown in FIG. 2.

As shown in FIG. 3, a box-shaped container 10, or a cartridge body, has an opening 12, which is sealed tightly and doubly by a sealing material 13.

The sealing material 13 is hot-glued or bonded with an adhesive to a peripheral flange portion 11 of the opening 12 of the container 10 to such a degree that the sealing material can be peeled from the peripheral flange portion.

The end portion 13*a* of the sealing material 13 is turned down at an adequate length from the free end as shown in FIG. 3 and bonded to the face 11*a* of a side of the peripheral flange portion 11. The part 13*b* of the sealing material 13 is bonded to the face 11*b* of the peripheral flange portion 11.

Figure 4:
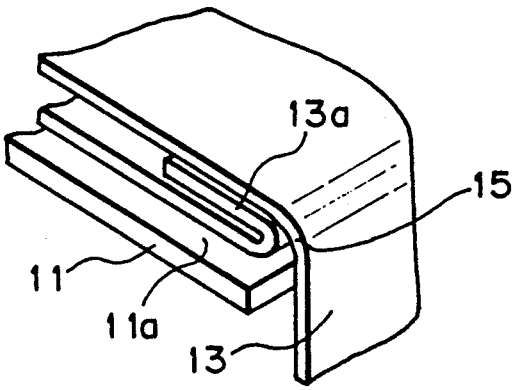
FIG. 4 is an enlarged view of an end portion of a sealing material of the developer cartridge shown in FIG. 2.

FIG. 4 shows enlarged detail of the end portion 13*a* of the sealing material 13. The sealing material 13 is turned down from the point fixed to the face 11*b* of the flange portion 11 so as to be turned 180°. The sealing material is also overlaid onto the turned-down end portion 13*a* over the overlapping portion 15.

Figure 1:
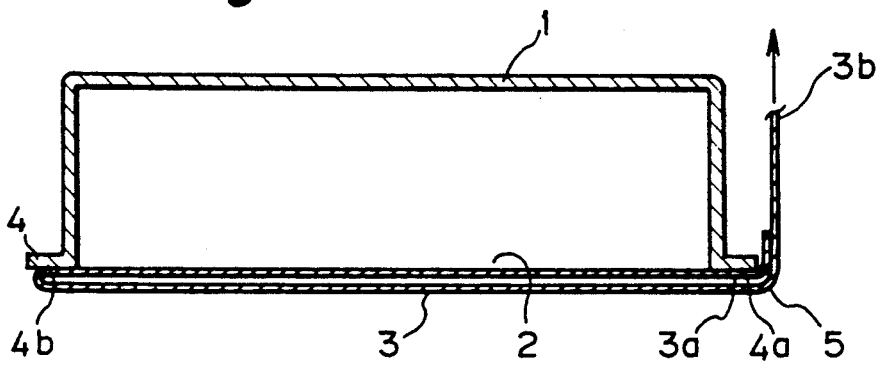
Fig. 1 PRIOR ART
FIG. 1 is a cross sectional view of a developer cartridge of the prior art.
Figure 2:
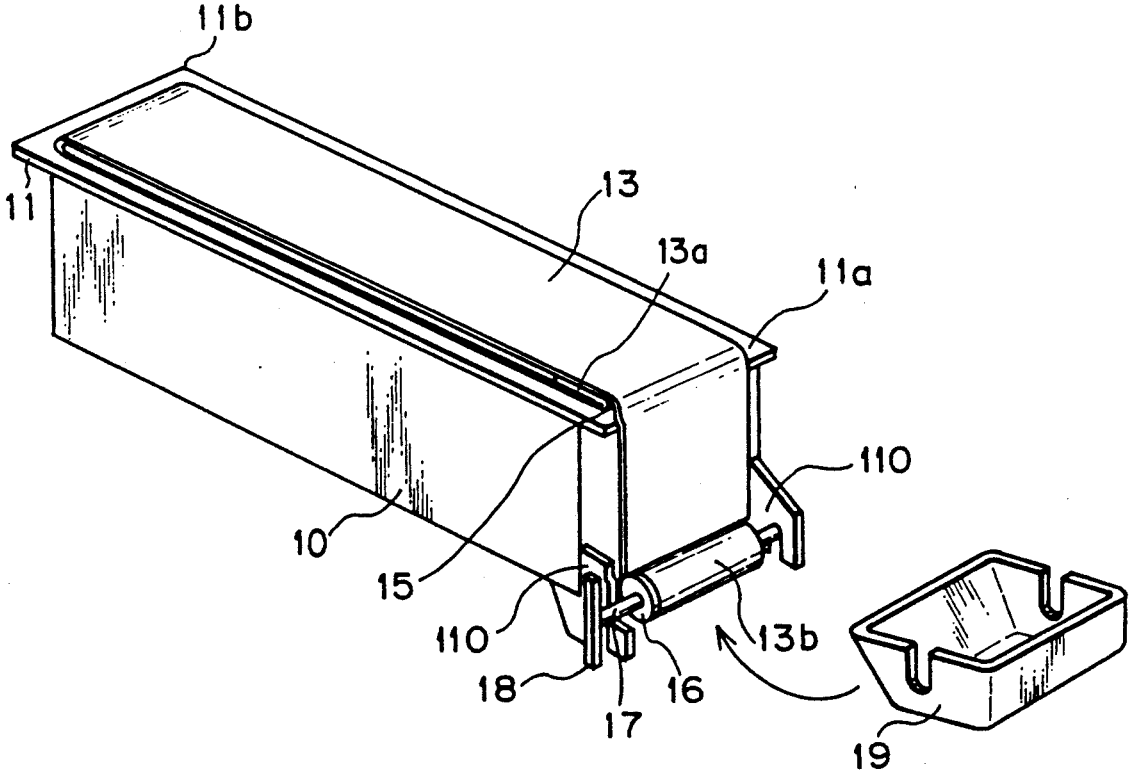
FIG. 2 is a perspective view of a developer cartridge according to a first embodiment of the present invention.

The sealing material extends further and the pulling-end portion 13*b* of the sealing material 13 is fixed to a roller 16 as shown in FIG. 2. The roller 16 is fixed to a shaft 17 rotatably supported between support pieces 110 formed integrally with the container 10. The pulling-end portion 13*b* of the sealing material 13 need not necessarily be fixed to the roller 16, but may be fixed directly to the shaft 17 supported rotatably. A handle 18 is attached to an end part of the shaft 17, and the roller 16 is rotated by turning the handle 18. The cartridge is also provided with a cover 19 for protecting the roller 16. FIG. 2 shows the cartridge that the cover 19 is detached.

The developer cartridge arranged as described above is filled with toner before its opening 12 is closed tightly with the sealing material 13.

Figure 5B:
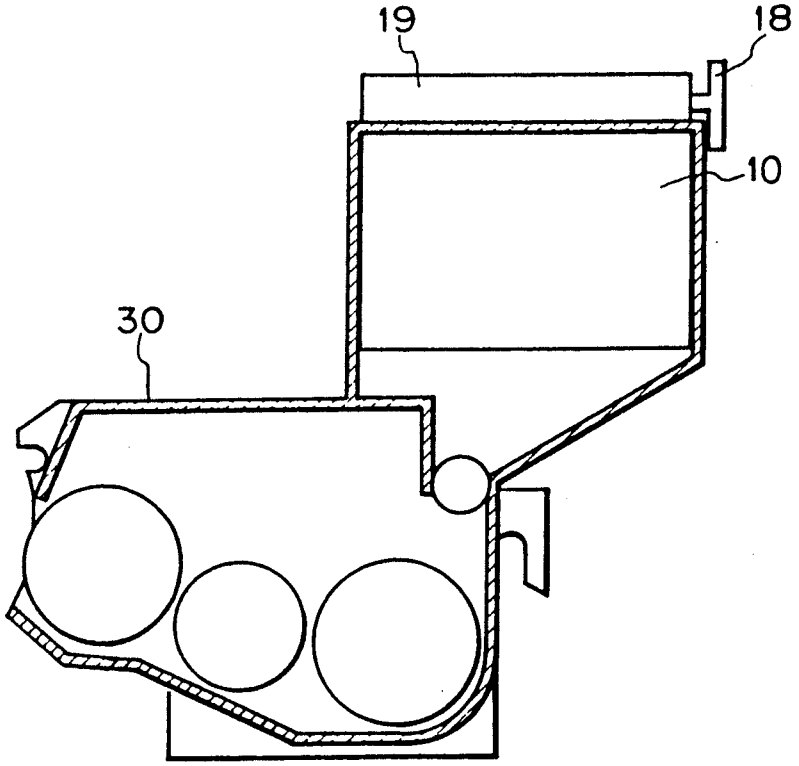
FIG. 5*b* is a cross sectional view of the arrangement shown in FIG. 5*a;*
Figure 5A:
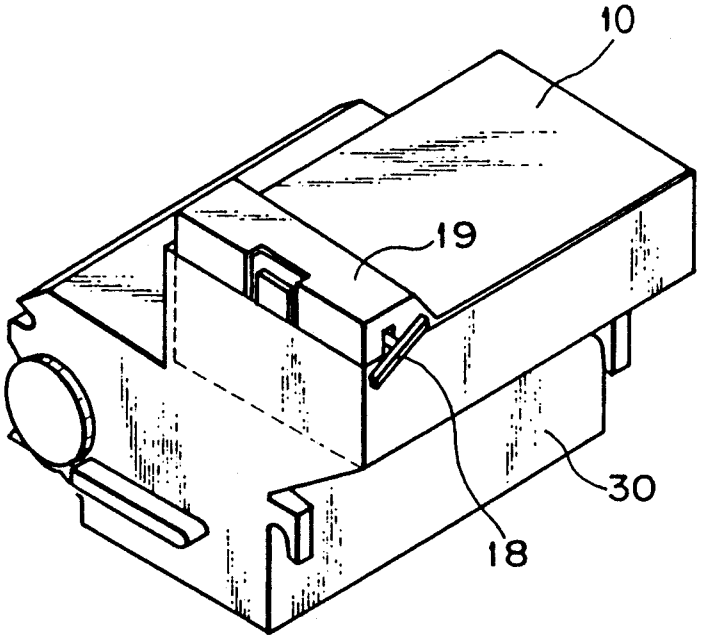
FIG. 5*a* is a perspective view of the developing cartridge, shown in FIG. 2, which is mounted on a developing device.

FIGS. 5*a* and 5*b* show the developer cartridge according to the present invention mounted in a electrophotographic copying apparatus including a developing device 30. When the toner in a developer tank of the developing device has run out, a message requesting replenishment of developer is generally displayed on the electrophotographic apparatus. In response to this message, the user replaces the old cartridge with a new cartridge filled with toner and covered with a sealing material. Then the new cartridge is attached in such a manner that the peripheral flange portion having the opening sealed by the sealing material covers an opening of the developer tank of the developing device. After the replacement, the sealing material is teared off from the opening by turning the handle 18.

Figure 6:
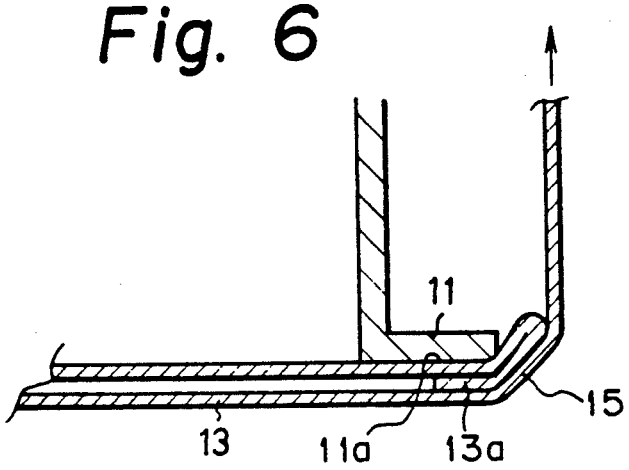
FIG. 6 is a enlarged view of an end part of the developer cartridge when peeling off the sealing material.

The sealing material 13 is pulled in the direction of the arrow as shown in FIG. 6 by means of the rotation of the roller. In this motion, the overlapping portion 15 of the sealing material 13 on the turned-down end portion 13*a* is displaced toward the pulling direction.

As a result, the frictional force caused at the overlapping portion 15 is reduced in comparison with a conventional sealing mechanism, and the sealing material 13 is peeled smoothly from the face of the peripheral flange 11. The rotation of the roller 16 by the handle 18 attached to the shaft 17 facilitates the peeling operation.

Figure 7A:
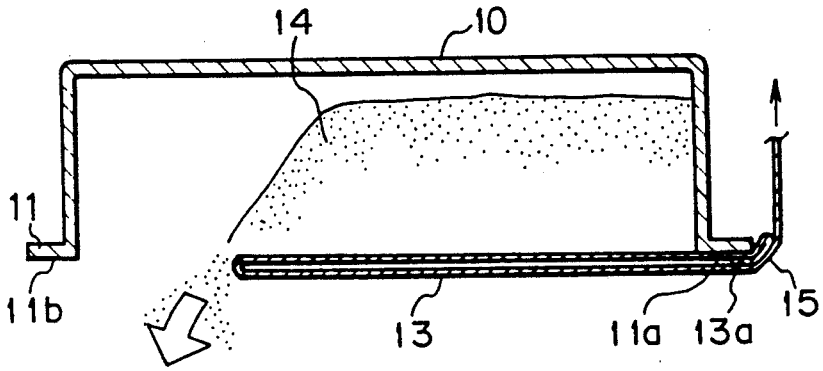
FIGS. 7*a* and 7*b* are cross sectional views of the developer cartridge when the sealing material is peeled off.
Figure 7B:
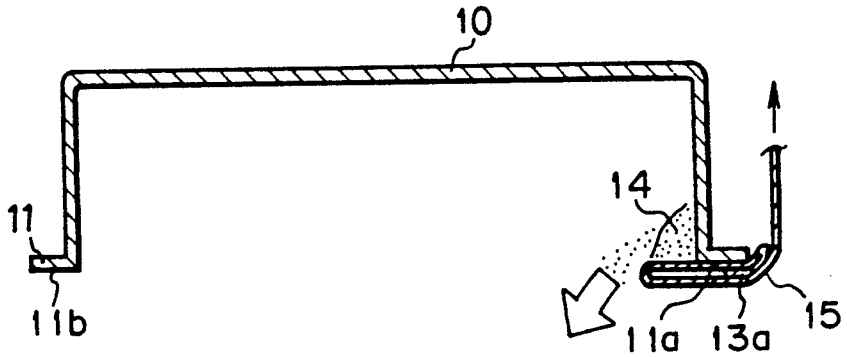

FIGS. 7*a* and 7*b* show the process by which the developer 14 filled in the container 10 is supplied to the developing device. As the sealing material 13 is peeled off, the developer 14 drops from a position near the face 11*b* of the peripheral portion of the opening 12 into the developer tank of the developing device. When the peeling of the sealing material 13 is completed, almost simultaneously the supply of the developer 14 is finished. During this process, the turned-down end portion 13*a* of the sealing material 13 is left in the displaced condition, and the frictional force between this end portion 13*a* and the other portion of the sealing material 13 which abuts the end portion 13*a* is small. Therefore, the sealing material 13 is peeled off smoothly.

Figure 8:
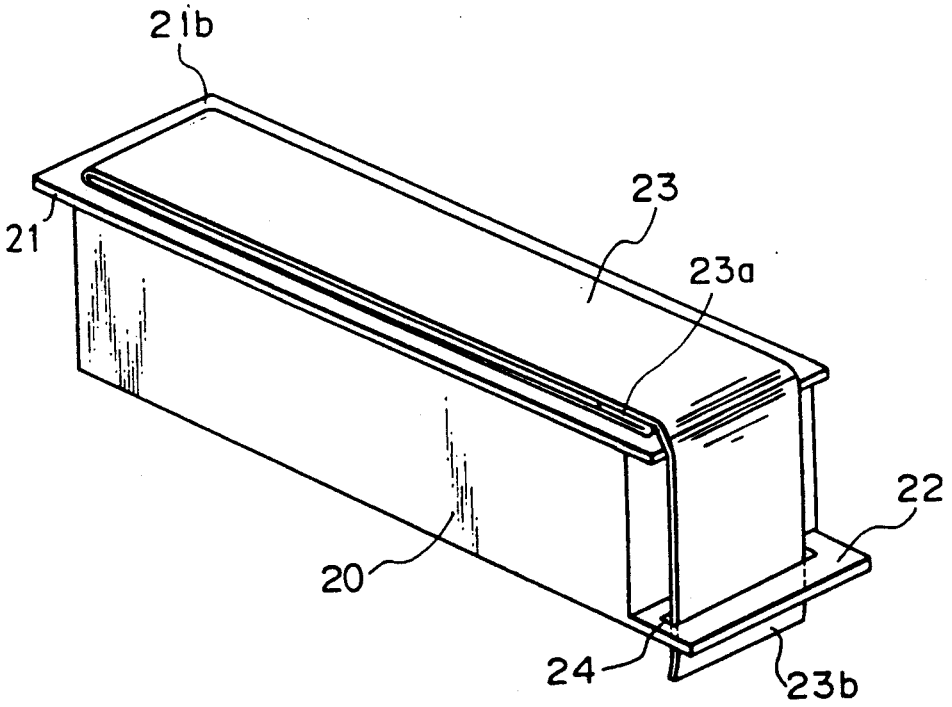
FIG. 8 is a perspective view of another embodiment of the developer cartridge according to the present invention.

FIG. 8 is a perspective view of another embodiment of the developer cartridge according to the present invention. Like in the first embodiment, the end portion 23*a* of the sealing material 23 is turned down at an adequate length from the free end and bonded to the face of the peripheral portion 21 of the container 20, and a part of the sealing material 23 is bonded to the other face 21*b* to cover the opening. The sealing material 23 is turned over for 180° from the point fixed to the face 21*b* of the peripheral flange portion 21, and covers the opening doubly. The sealing material 13 is bent at the side of the free end 23*a* and the pulling end portion 23*b* of the sealing material 23 is passed through an opening 24 of a projecting portion 22 disposed at the surface of the container 20.

Figure 9B:
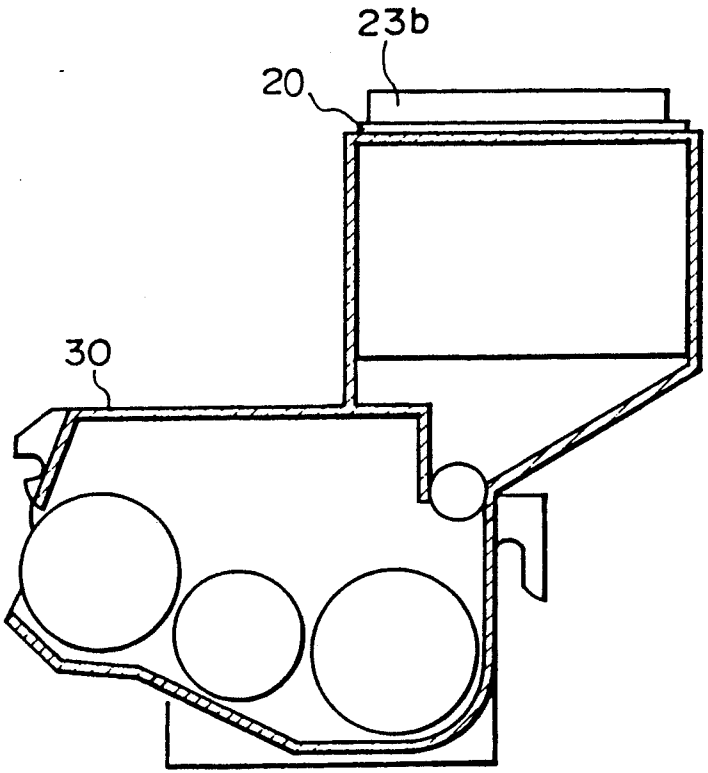
FIG. 9*b* is a cross sectional view of the arrangement shown in FIG. 9*a*.
Figure 9A:
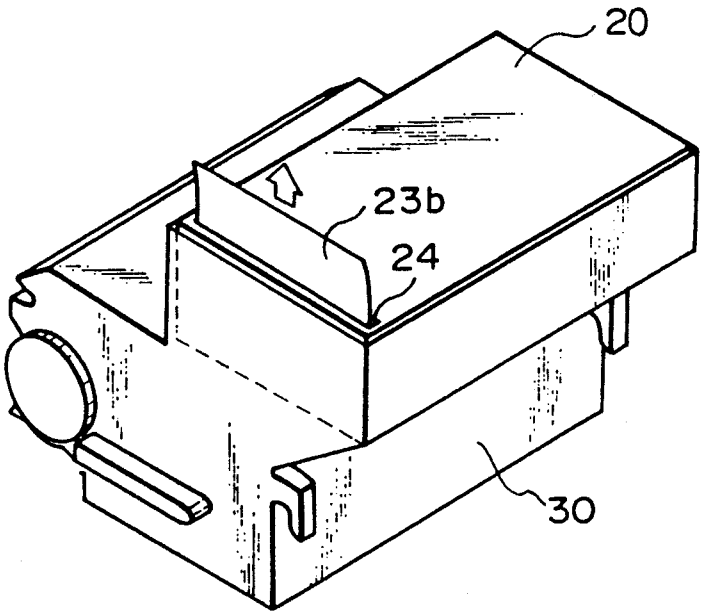
FIG. 9*a* is a perspective view of the developer cartridge, shown in FIG. 8, which is mounted on the developing device.

In this embodiment the sealing material 23 is teared off by pulling the pulling portion 23*b* of the sealing material 23. FIGS. 9*a* and 9*b* show this developer cartridge mounted in a electrophotographic copying apparatus including a developing device 30.

When the toner in a developer tank of the developing device has run out, a message requesting replenishment of developer is generally displayed on the electrophotographic apparatus. In response to this message, the user replaces the old cartridge with a new cartridge filled with toner and covered with a sealing material. Then the new cartridge is attached in such a manner that the peripheral flange portion having the opening sealed by the sealing material covers an opening of the developer tank of the developing device. After the replacement, the sealing material is teared off from the opening by pulling the free end 23*a* of the sealing material. The sealing material 23 is pulled in the direction of the arrow as shown in FIG. 9*a*.

Like the first embodiment the sealing material 13 is peeled smoothly from the peripheral flange of the developing cartridge body because the overlapping portion 15 of the sealing material is displaced toward the pulling direction and then frictional force caused at the overlapping portion 15 is reduced in comparison with a conventional sealing mechanism as shown in FIG. 6.

Many widely different embodiments of the present invention may be constructed without departing from the sprint and scope of the present invention. It should be understood that the present invention is not limited to the specific embodiments described in the specification, except as defined in the appended claims.

What is claimed is:

1. A developer cartridge used for replenishing a developer to a developing device comprising:

a container containing said developer and having an opening for supplying said developer; and a sealing material having a first portion adhered to a peripheral portion of said opening to seal said opening, a second portion turned down at one end of said first portion to extend along and to cover said first portion, and a free end portion turned down at the other end of said first portion and sandwiched between said first portion and said second portion.

2. A developer cartridge according to claim 1, wherein said sealing material is adhered to said peripheral portion of said opening to be peeled from said opening by pulling the other free end portion of said sealing material.

3. A developer cartridge according to claim 2, wherein said cartridge further comprises a rotating member attached at a side surface of said container, the other end portion of said sealing material being fixed at said rotating member.

4. A developer cartridge according to claim 3, wherein said rotating member has a handle for facilitating the rotation of said rotating member.

5. A developer cartridge according to claim 2, wherein said cartridge further comprises a projecting portion having an opening through which the other end portion of said sealing material is pulled and peeled from said opening of said cartridge.

* * * * *